United States Patent [19]

Vidal

[11] 4,045,965

[45] Sept. 6, 1977

[54] QUAY STRUCTURE

[76] Inventor: Henri C. Vidal, Paris, France

[21] Appl. No.: 590,730

[22] Filed: June 26, 1975

[51] Int. Cl.[2] ..... E02D 5/00

[52] U.S. Cl. ..... 61/39; 61/49

[58] Field of Search ..... 61/35, 39, 49

[56] References Cited

U.S. PATENT DOCUMENTS

| | | | |
|---|---|---|---|
| 981,822 | 1/1911 | Upson | 61/49 |
| 1,695,997 | 12/1928 | Evers et al. | 61/39 X |
| 1,762,343 | 6/1930 | Munster | 61/39 |
| 2,018,423 | 10/1935 | Smith | 61/39 |
| 2,138,037 | 11/1938 | Lane | 61/35 |
| 2,566,748 | 9/1951 | Ringrose | 61/39 X |
| 2,941,371 | 6/1960 | Benedict et al. | 61/49 |
| 3,613,382 | 10/1971 | Dickinson | 61/49 |
| 3,686,873 | 8/1972 | Vidal | 61/39 |

*Primary Examiner*—Paul R. Gilliam
*Assistant Examiner*—David H. Corbin
*Attorney, Agent, or Firm*—Burns, Doane, Swecker & Mathis

[57] ABSTRACT

A quay structure is disclosed. The structure includes a wall constructed of a plurality of wall panels. Elongated truss members are secured to the inner side of the wall panels. The wall panels are stacked vertically to form the wall, with the truss members extending generally horizontally from their respective wall panels. Vertical truss members maintain the horizontal truss members in the proper relation to each other. The space on the land side of the wall and between and around the truss members and the support members is filled with prepared or natural particulate material. The frictional engagement of the fill material on the truss members and all of the elements of the wall provides a firm structure for berthing ships along the wall. At the top of the wall, a monolithic cope member is superimposed on the particulate fill material. Ladders, bollards and other special navigation and handling devices are also disclosed.

20 Claims, 11 Drawing Figures

QUAY STRUCTURE

BACKGROUND OF THE DISCLOSURE

This invention relates to wharves, and more particularly to quays for conveniently loading and unloading ships.

There are several methods of constructing wharves. One method is to drive piles into the earth along or adjacent the shore of a navigable body of water. A platform is then constructed across the top of the piles. A channel is dredged along the wharf to allow a fully-loaded ship to tie up at the wharf without touching the bottom when the water is at its lowest level.

The wharf must be capable of supporting heavy loads of cargo and equipment encountered in loading and unloading a ship. The wharf also must resist the impacts of the vessels while berthing against the wharf. Consequently, the structural components of the wharf must be massive and sturdy. Piles individually are not massive and sturdy, but by adding bracing between piles, a reasonably rigid structure can be provided. This method of construction is slow and expensive.

Another disadvantage is that in cold climates, there is the danger of ice pressure and friction on the piles and bracing. This problem is aggravated when the water level rises and falls due to the effects of tide. In some areas of the Northern Hemisphere, the tide may rise and fall as much as 50 feet.

One alternative is to construct a solid quay structure adjacent the shore by sinking large reinforced concrete caissons in a row along the shore, and ballasting the caissons with fill. The area between the caissons and the shore is then back filled to the level of the top of the caisson. This method of wharf construction is a good one because of the large mass of the structure. However, the caissons must be partially precast in a dry area, and then floated and towed to the site where casting resumes up to completion. Furthermore, it is necessary to prepare a foundation underwater and to sink the caissons at the proper place on the foundation. All of these operations are very expensive.

Other alternatives for wharf construction use steel sheet piling either to constitute a curtain with anchorages containing the backfill for the quay platform, or form a sequence of jointed cells to be filled in order to obtain a gravity wall at the back of which the platform is backfilled. These alternatives require large amounts of costly steel and are often subject to incidental rupture of the tie-rods and anchorages, or to unfastening of the steel sheet file locks, particularly near the bottom imbedded in the foundation soil.

SUMMARY OF THE INVENTION

In view of these deficiencies of prior structures, it is an object of this invention to provide an improved quay structure.

Another object of the invention is to provide a quay structure which is capable of being constructed efficiently.

A further object of the invention is to provide a quay structure which is very stable even when the soil of the foundation is not sufficiently sound for other methods of construction.

The foregoing objects are accomplished in accordance with a preferred embodiment of this invention by a quay structure which includes an upright wall formed of a plurality of wall panels. A plurality of truss members are secured to the shore side of each wall panel and the truss members extend substantially horizontally from the wall toward the shore. At the end opposite the panel, each truss member is wedged up by vertical truss members, which rest on the next lower vertical truss or on the soil. The space behind the wall and around the horizontal and vertical members is filled with prepared or natural particulate material. Along the top of the wall, additional wall panels are provided. These wall panels have a plurality of thin, flexible reinforcement members secured to the wall panels. The reinforcement members extend in horizontal layers away from the wall panels toward the shore, and the space behind the wall and around the reinforcement members is filled with prepared or natural particulate material.

A cope member extends along the top of the wall, resting essentially on the top of the backfill. The weight of the cope member is not imposed directly on the wall panels. The cope member includes one or more bollards, with means for reinforcing the cope structure around the bollards.

The wall panels are preferably hexagonal. At the base of the wall, base members are provided with upright guides that extend to the height of the high water level. The guides are received in slots in the ends of the wall panels to position the panels properly during assembly. The hexagonal shapes of the panels assists in guiding the panels to seat properly on the preceding course of panels. A tongue and groove joint and plastic material at the edges of the panels interlocks the panels and forms an effective seal.

The wall panels and the cope well are shaped and equipped to receive ladders and all other necessary devices as required by berthing and handling operations on the wharf.

This invention incorporates the principles of reinforced earth construction as disclosed in U.S. Pats. Nos. 3,421,326 and 3,686,873, and the disclosures of these patents are incorporated herein by reference.

DESCRIPTION OF THE DRAWINGS

A preferred embodiment of the invention is illustrated in the accompanying drawings in which.

DESCRIPTION OF THE PREFERRED EMBODIMENT

Figure 1:
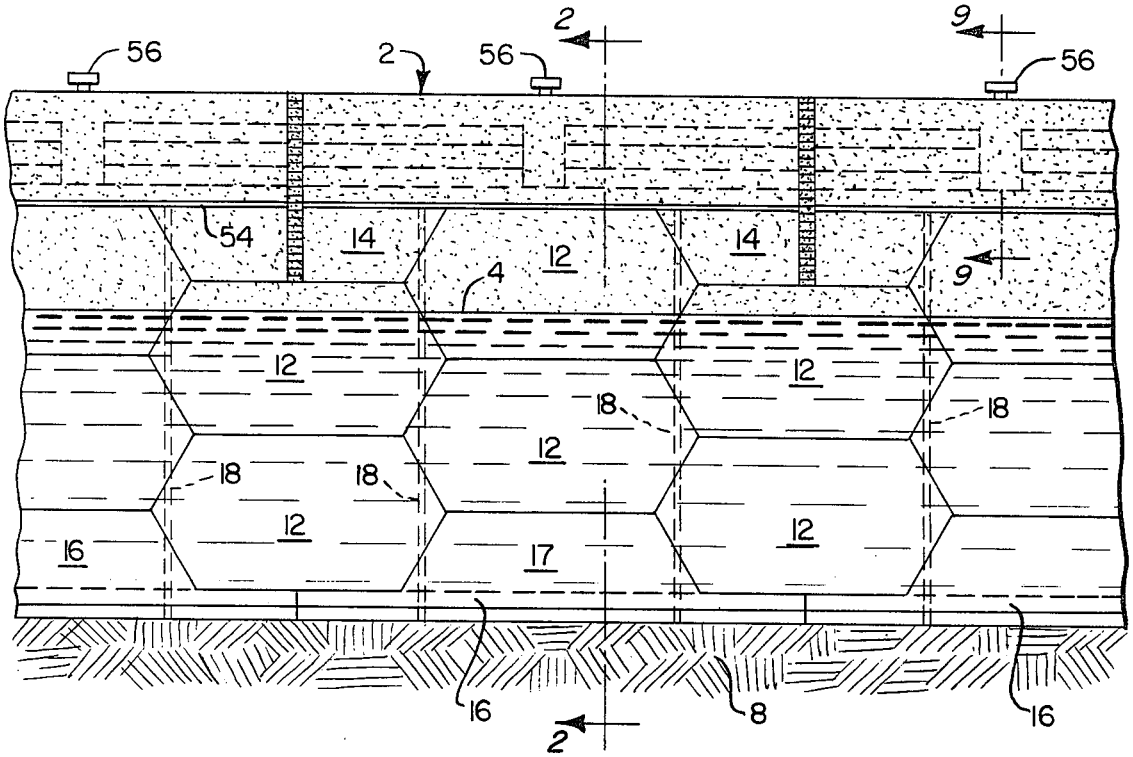
FIG. 1 is an elevational view of the quay structure viewed from the water side.
Figure 2:
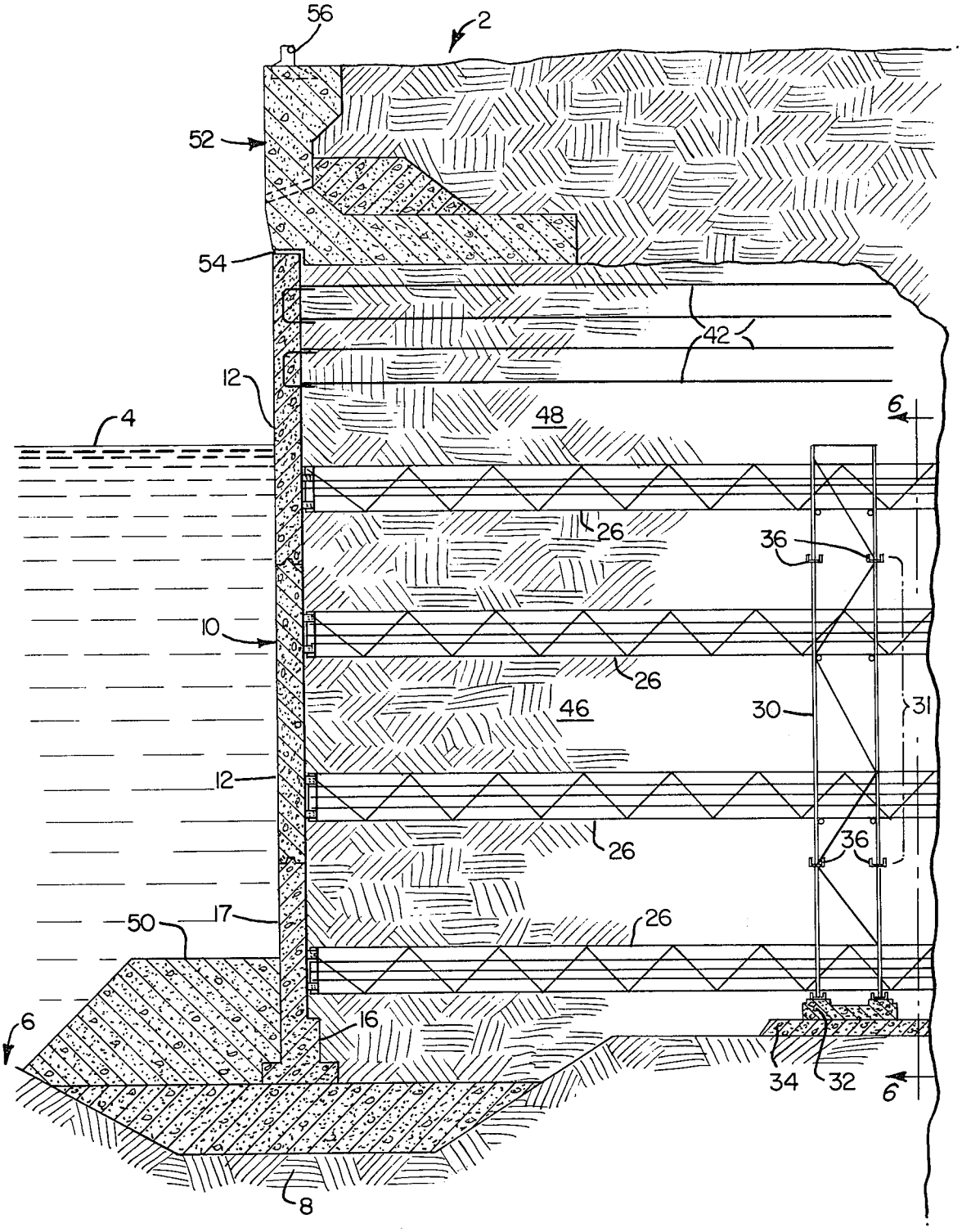
FIG. 2 is an enlarged cross-sectional view of the quay structure along the line 2—2 in FIG. 1.

A quay structure 2 constructed in accordance with this invention is illustrated in FIGS. 1 and 2. Typically, a quay structure extends along the bank or shore of a body of water. The average water level 4 is shown with respect to the structure, although in tidal waters, the water level may rise and fall appreciably. Beneath the water, the bottom 6 is dredged and filled with rock or similar material to provide a foundation 8 on which a quay wall 10 is constructed.

The wall 10 includes a plurality of full wall panels 12, and partial panels 14 along the top of the wall. At the foot of the wall, a plurality of base members 16 are supported on the foundation 8. For optimum economy and better quality, the panels 12, partial panels 14, and base members 16 are precast in concrete at or near the construction site.

Figure 3:
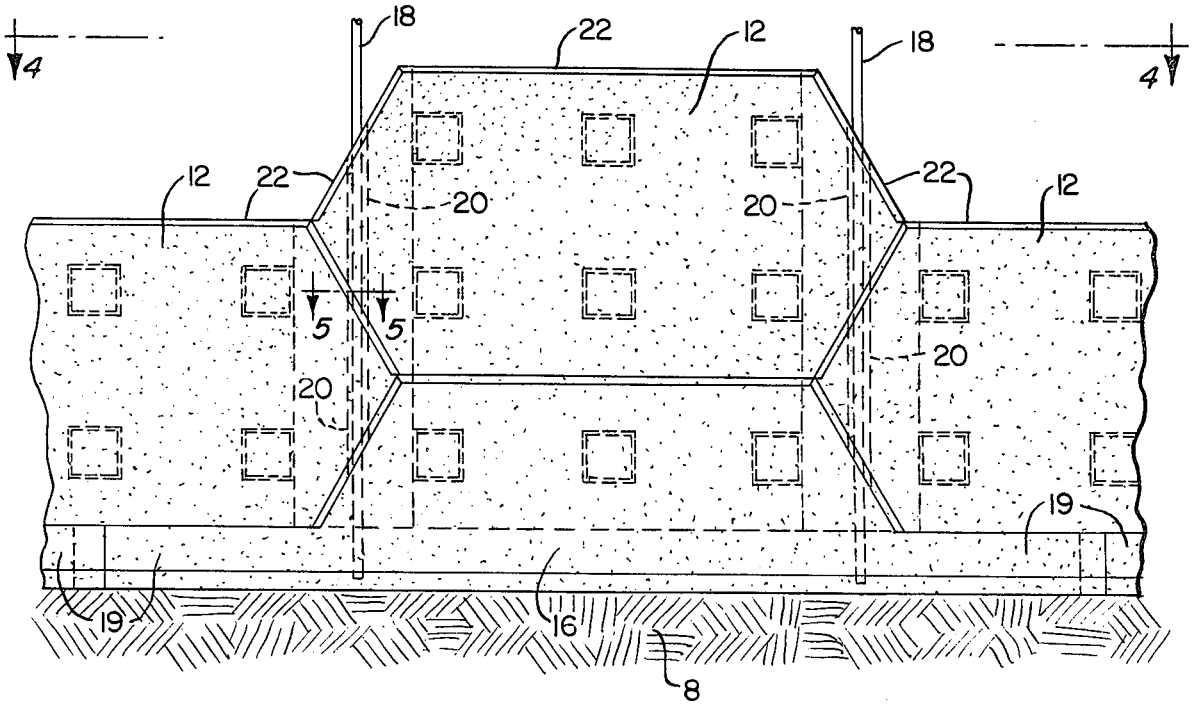
FIG. 3 is a detail elevational view of the quay structure during an intermediate stage of construction.
Figure 4:
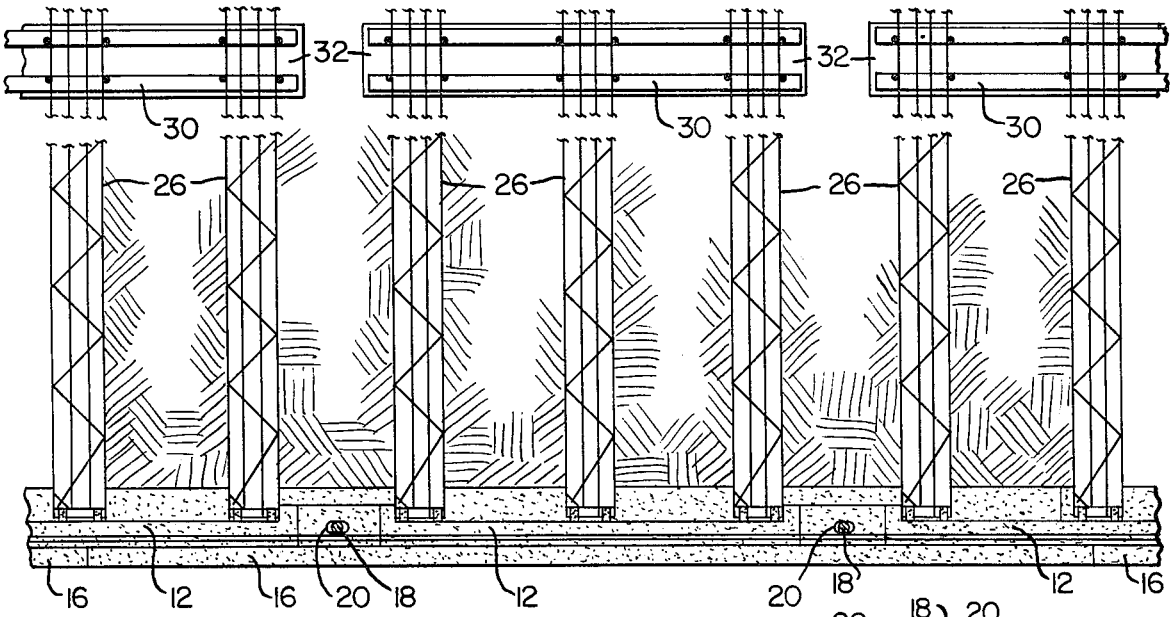
FIG. 4 is a cross-sectional view of the quay structure along the line 4—4 in FIG. 3.
Figure 5:
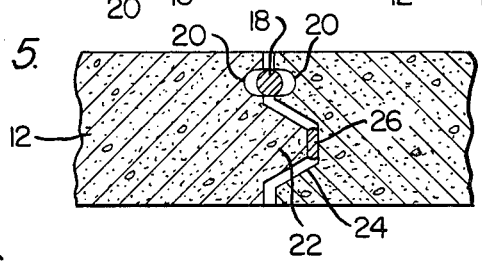
FIG. 5 is a cross-sectional view of the wall panels along the line 5—5 in FIG. 3, and showing the joint detail.
Figure 6:
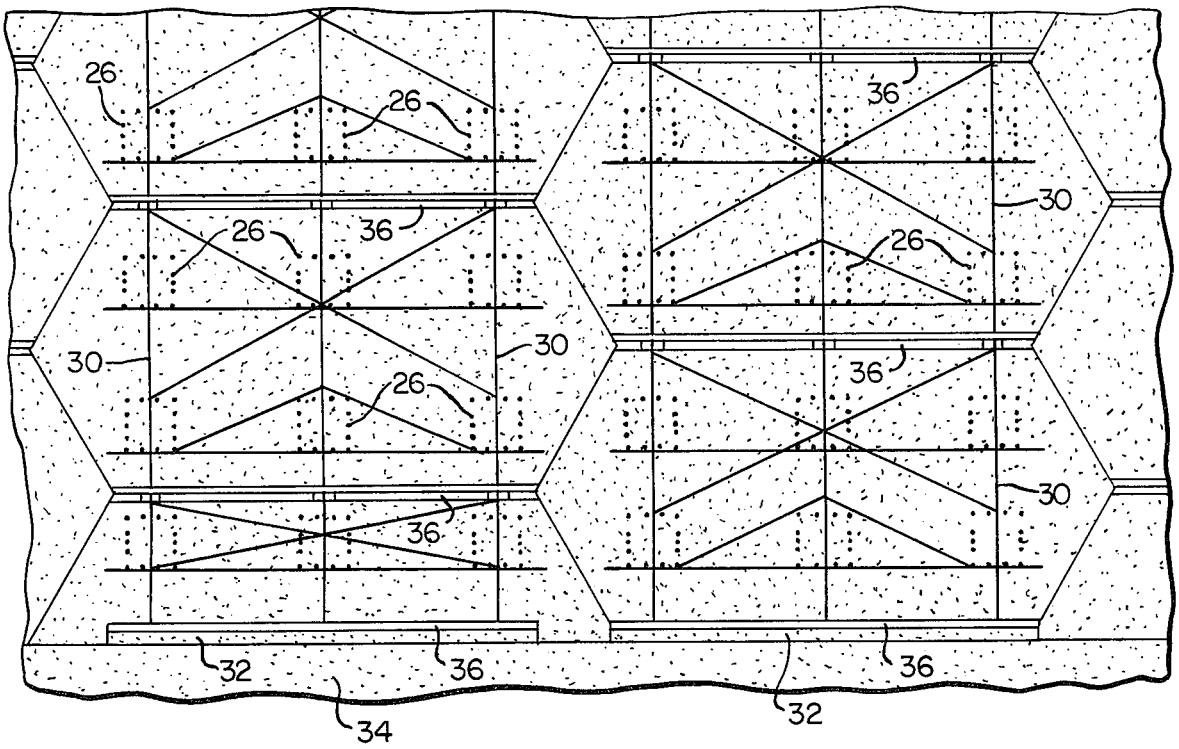
FIG. 6 is a cross-sectional view of the structure along the line 6—6 in FIG. 2.
Figure 7:
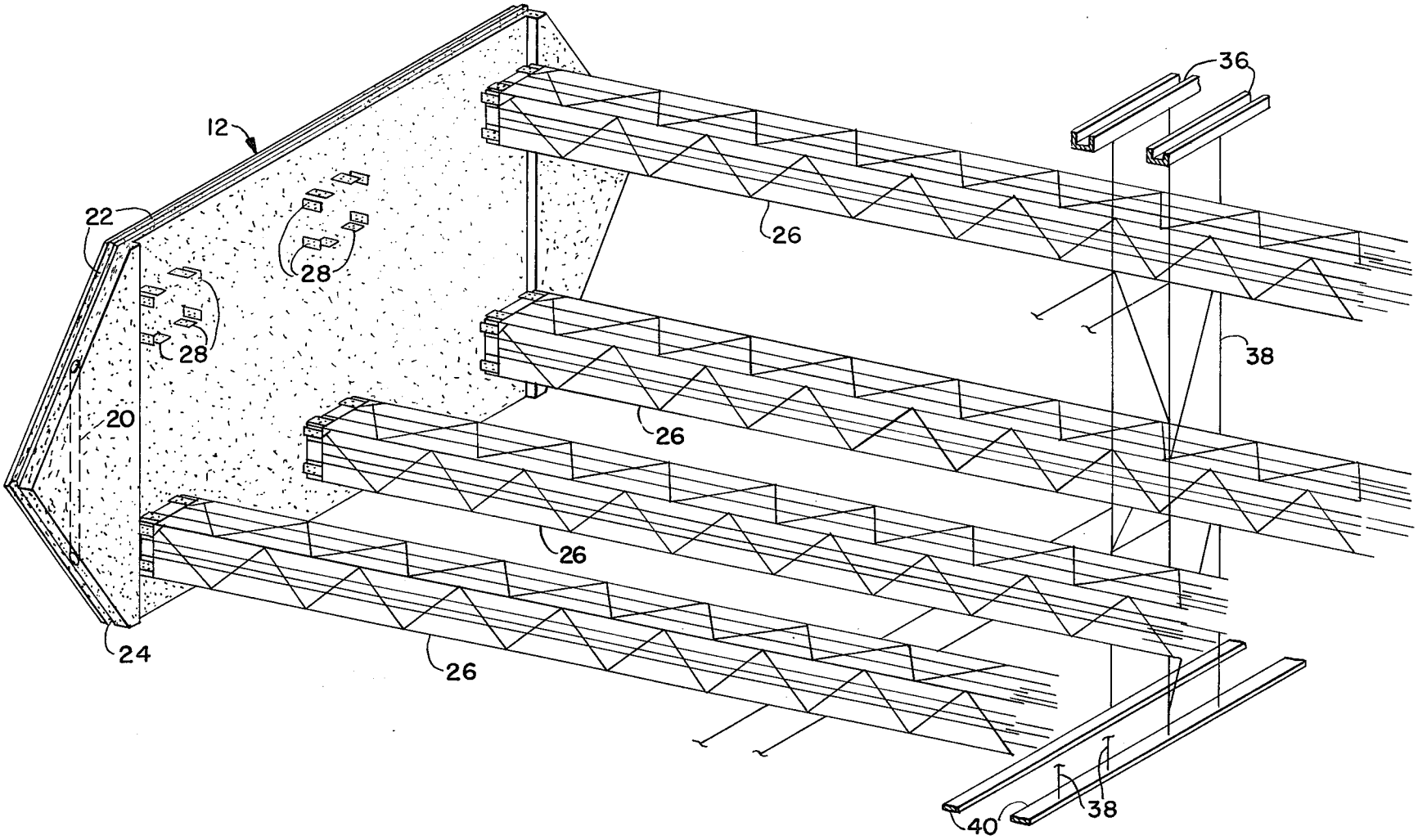
FIG. 7 is a perspective view of a wall panel with associated horizontal truss members and vertical truss members.

The base members 16 are elongated and are arranged in end-to-end relation, as shown in FIGS. 1, 3 and 4. The central portion 17 of the base member 16 has substantially the same size and shape as the upper half of the one of the panels 12. At each end, the base member 16 has a lateral extension 19 to support the lower edge of one of the panels 12. Each of the base members 16 also includes a pair of upright quides 18 which are fixed at the lower end in the base member 16. Each of the panels 12 and 14 have vertical slots 20 arranged to receive the guides 18.

As shown in FIGS. 3–6, each panel 12 has a hexagonal shape and is symmetrical about vertical and horizontal axes. The upper and lower edges of the panels are substantially parallel to the horizontal axis. At the end of each panel, the upper inclined edges and the lower edges slope at approximately 60° from the horizontal axis. In order to facilitate the assembly of the wall panels, the panels are arranged in vertical rows, and adjacent vertical rows of panels are offset by the height of one-half of a panel. This arrangement positions the upper inclined edges of the panels adjacent the top edge of the panel in the next row, as shown in FIG. 3. When a panel 12 or 14 is placed between the preceding panels, these upper edges cooperate to guide the subsequent panel into position. The upper inclinded edges and the horizontal top edge of each panel are provided with a tongue or rib 22, and the lower edges are provided with a corresponding groove 24. Preferably, a deformable seal 26 (FIG. 5) is placed between the tongue 22 and the groove 24 to prevent the leakage of backfill through the wall while keeping the wall previous to the water. The central portion 17 of the base member 16 has the shape corresponding to the upper portion of the panels 12, and the half panels 14 have a shape corresponding to the lower portion described for the panels 12.

Figure 8:
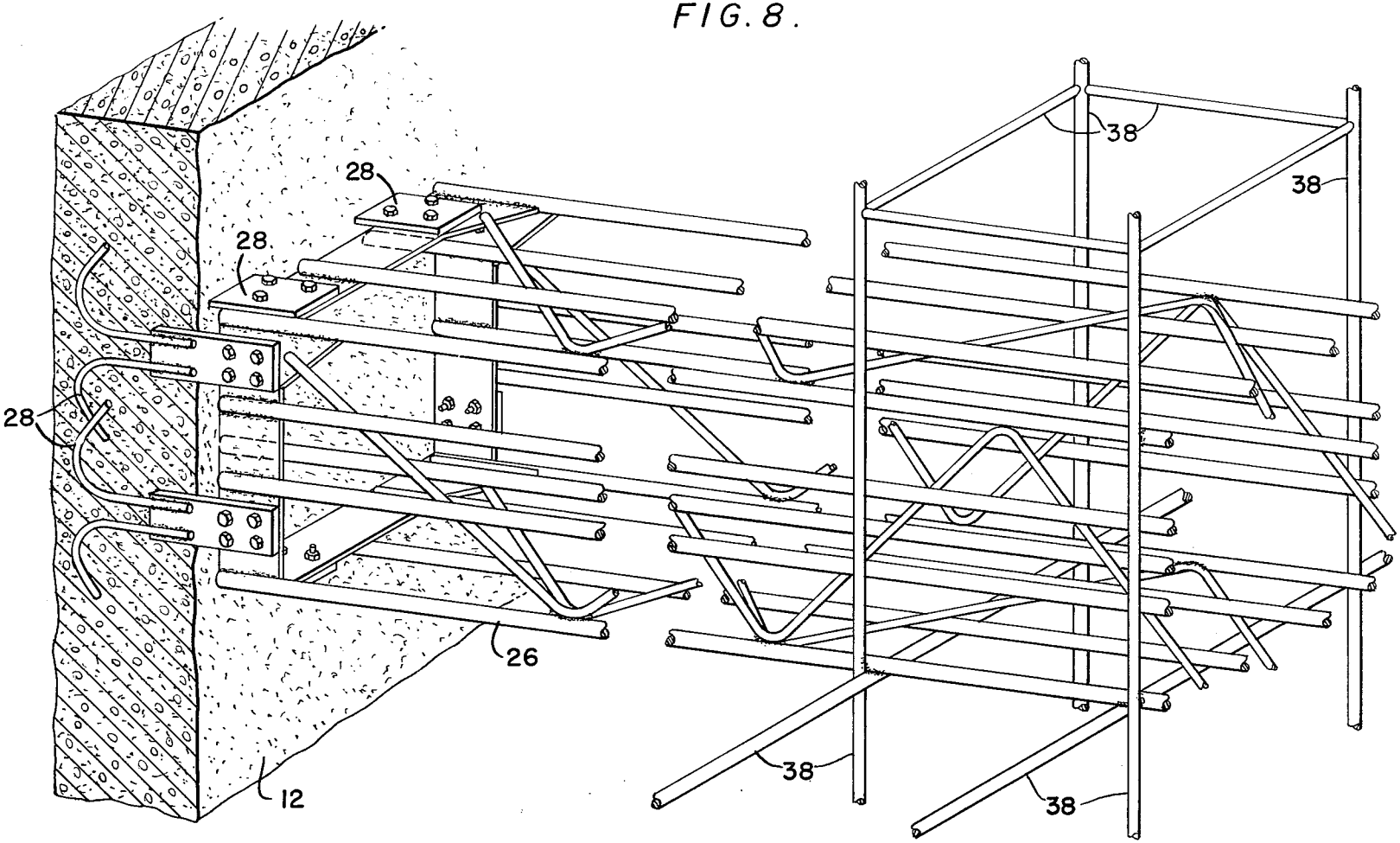
FIG. 8 is a detailed perspective view showing the attachment between the wall panel and a horizontal truss member.

Referring to FIGS. 2–7, each of the panels 12 has a plurality of horizontal truss members 26 secured to the land side of the panel. Similarly, the base members 16 also have truss members 26 secured thereto. As shown in FIG. 8, the truss members 26 are preferably constructed of steel bars welded together in a rigid framework. The truss members 26 are designed to support tensile stresses, and to avoid significant deflection horizontally and vertically while the wall is being constructed. The truss members 26 are secured to the panels 12 by anchors 28 embedded in the panels.

As shown in FIG. 2, a vertical truss or tower structure 30 is spaced from the land side of the wall 10 and supports the horizontal truss members 26 in a substantially horizontal position. The tower 30 includes a footing 32 supported on a foundation 34 of crushed rock, or other suitable materials.

The tower 30 is constructed in separate sections 31 corresponding to each of the panels 12 and base members 16. Each tower section for a full panel 12 is provided at the top with a pair of horizontal channels 36 (FIG. 7) which extend approximately parallel to the face of the panels. The channels 36 are supported by steel bars 38 which extend generally vertically between the truss members 26 and which join the truss members together to form a rigid framework. At the lower end of the tower section, a pair of runners 40 are welded or otherwise secured to the bars 38 in alignment with the channels 36, so that the runners 40 are received in the channels 36 and supported thereby, when the tower sections are stacked on one another, as shown in FIG. 2.

At the top of the wall, the half panels 14 and the uppermost full panels 12 project above the level of the water 4. Instead of the truss members 26, reinforcement strips 42 are secured to the upper portion of each of the uppermost panels 12. The reinforcing elements 42 are substantially the same as those described in Vidal U.S. Pat. No. 3,686,873. The reinforcing elements 42 are attached to anchors 44 which are embedded in the panels 12. The lower portion of the uppermost panels 12 is provided with truss members 26 and the lower half of a tower section, as shown in FIG. 2. The half panels 14 are also provided with reinforcing elements 42 that are secured to the panels by anchors 45 corresponding to the anchors 44.

The space on the land side of the wall 10 from the bottom 6 to a level above the water level 4 is filled with coarse fill material 46, such as crushed rock or gravel. Above the fill 46, fill material 48 compatible with the reinforcing elements 42 fills the space behind the panels 12 and 14 and around the reinforcing elements 42. Suitable fill material 48 includes earth, sand, small size gravel, or other particle material as described in Vidal U.S. Pat. No. 3,421,326. At the foot of the wall 10, a protective berm 50 (FIG. 2) extends throughout the length of the wall.

A cope wall 52 is superimposed on the fill 48 and is supported on the fill independently of the wall 10. A gap 54 is preferably provided between the panels 12 and 14 and the cope wall 52 to ensure that the cope wall does not engage the wall 10.

Figure 9:
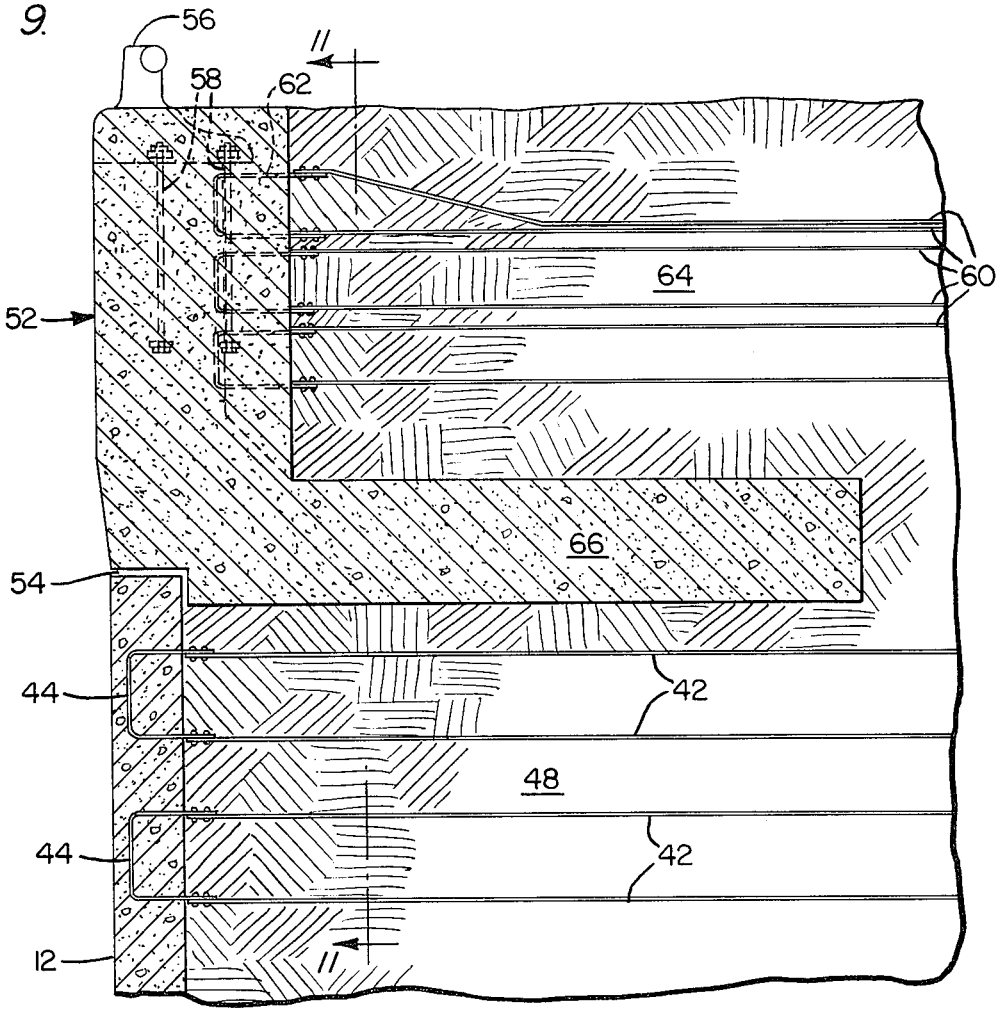
FIG. 9 is a detailed cross-sectional view of the cope structure and the bollard along the line 9—9 in FIG. 1.
Figure 10:
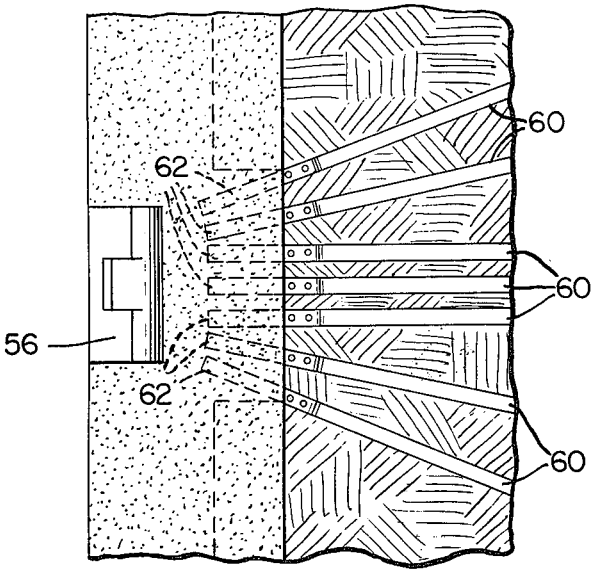
FIG. 10 is a top plan view of the cope and bollard assembly, as shown in FIG. 9, but with portions of the fill removed for the purpose of illustration.
Figure 11:
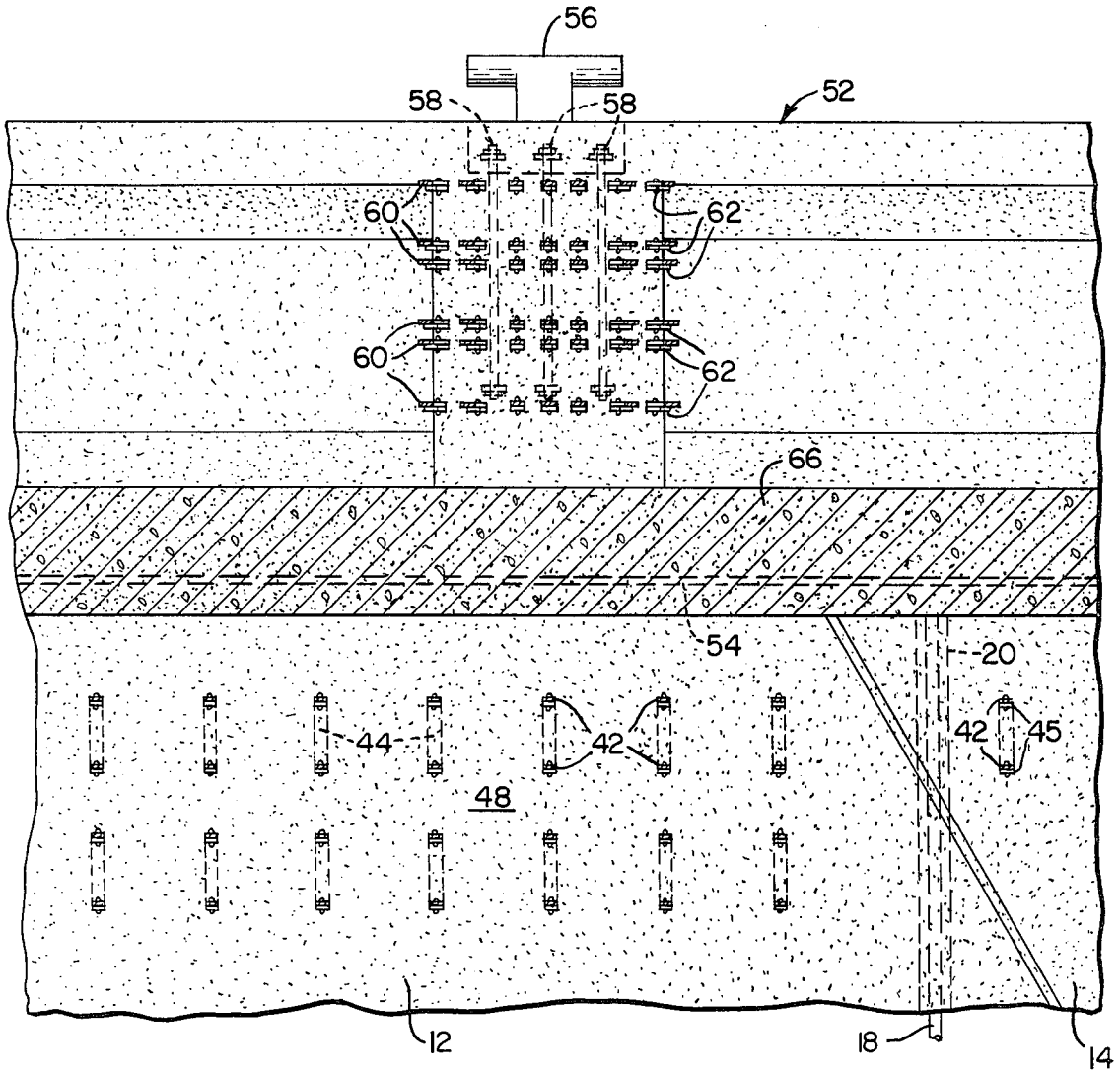
FIG. 11 is a cross-sectional view of the structure along the line 11—11 in FIG. 9.

Preferably, the cope well 52 is a monolithic structure of concrete which is cast in situ. Spaced at intervals along the top of the cope wall are bollards 56 for tying up ships. The bollards 56 are secured in the cope wall 52 by anchor bolts 58. A ship tied to the bollards 56 exerts a large force tending to pull the cope wall 52 in the direction of the ship, due to wave action, water current, or wind, for example. To resist this tendency, a plurality of reinforcing elements 60 extend outwardly from the rearward side of the cope wall 52 as shown in FIGS. 9–11. The reinforcing elements 60 of thin flexible material, but having high tensile strength, as described in Vidal U.S. Pat. No. 3,686,873, are secured to the cope wall by anchors 62 embedded in the wall. A suitable fill 64 is placed over the fill 48 and between the reinforcing elements 60. The fill 64 is a particulate material , as described in Vidal U.S. Pat. No. 3,421,326. The base 66 of the cope wall extends a sufficient distance from the face of the wall to provide sufficient support for the monolithic structure 52. The frictional engagement between the base 66 and the surrounding fill 64 and 48 resists displacement of the structure relative to the fill 48 and 64.

The quay structure may be readily constructed even in deep water by providing first a level foundation 8 for the wall 10 and a foundation 32 for the tower 30. The base members 16 are placed on the foundation 8 and leveled. The first course of panels 12 is then lowered, with the guides 18 passing through the slots 20 until the downwardly inclined edges of the panels engage the corresponding edges of the base members 16. At the same time, the truss members 26, which are previously attached to the panels 12, are positioned horizontally by stacking the runners 40 of the tower section 31 on the channels 36 that extend along the upper surface of the base 32. Each successive panel is installed in sequence in the same manner. When the uppermost course of truss members 26 has been installed, fill 46 is deposited in the space on the land side of the wall 10 to substantially fill the space to a height above the level of the water 4.

The reinforcing members 42 are then arranged on successive layers of fill 48, so that the space around the reinforcing elements 42 is substantially filled, and the surface is leveled to receive the cope wall 52.

The cope wall 52 may be cast in situ and rest on the upper surface of the fill 48. The frictional engagement between the base 66 and the fill material 48 prevents displacement of the cope wall 52.

The reinforcing strips 60 are arranged in successive layers in the fill 64 adjacent each of the bollards 56, and the fill 64 is leveled.

The quay structure of this invention has many advantages over prior structures: economy, flexibility, stability and massiveness. The wall 10 can be constructed under water. The panels may be relatively large in size to obtain maximum economy, and for faster and more accurate construction. For example, the panels may be of the order of 40 feet in length and 20 feet in height, and on precast concrete.

While this invention has been illustrated and described with reference to a preferred embodiment, it is recognized that variations and changes may be made therein, without departing from the invention as set forth in the claims. For example, this invention may be utilized in constructing retaining walls on an underwater foundation.

What is claimed is:

1. A quay structure comprising:

a wall having a plurality of wall panels, said panels being arranged in vertical rows with the panels in adjacent rows, engaging each other in edge to edge relation with a tongue and groove connection, each wall panel including a plurality of rigid framework truss members attached at one end to each of said wall panels, said truss members extending in substantially parallel relation away from one side of said wall, rigid framework tower means for providing a plurality of vertically spaced supports, said tower means being spaced from said wall on said one side and including means for supporting the tower means of an adjacent wall panel, said truss members being supported on said tower supports in spaced relation to each other; and particulate material substantially filling the space between said tower means and said one side of said wall, and surrounding said truss members and said tower means.

2. A quay structure according to claim 1 wherein said truss members include a plurality of steel bars extending continuously from adjacent said wall panels at least to said tower means.

3. A quay structure according to claim 1 wherein said tower means includes a plurality of tower sections, one of said sections and a plurality of said truss members and one of said panels being secured together in a unitary structure.

4. A quay structure according to claim 3 wherein said tower sections include means for assembling said tower sections together, said means for assembling including channel members and runner members received in said channel members.

5. In a wall, of the type having a plurality of wall panels superimposed on each other and a plurality of reinforcing members extending outwardly from one side of said panels, and particulate material filling the space adjacent said one side of said panels and between said reinforcing members, the improvement of a plurality of unitary structures, each of said structures including one of said panels and plurality of said reinforcing members and a tower section, each of said reinforcing members being formed of a plurality of bars secured to said panel and extending outwardly from said panel, said bars being spaced from each other and secured together in a rigid framework, said tower section being secured on and extending between at least two members and having means for supporting the tower means of an adjacent unitary structure, said reinforcing members extending between said panel and said tower section, said panels having guide slots, and vertically extending guides received by said guide slots to position adjacent unitary structures.

6. A wall according to claim 5 wherein said tower section has substantially the same height as said panel.

7. A wall according to claim 5 wherein said panel is hexagonal, two parallel sides of said panel having a greater length than all the remaining sides of said panel.

8. A wall according to claim 7 wherein said panel has a tongue extending along the upper edges and a groove extending along the lower edges, and said tower section includes means for connection with tower sections of other unitary assemblies.

9. A wall according to claim 5 wherein said unitary structures are arranged in vertical rows with the panel and tower section of one structure being superimposed on a corresponding panel and tower section of another of said structures.

10. A wall structure according to claim 9 wherein at least one of said unitary structures is in the form of a base member, said base member having a panel and lateral extensions aligned with said panel for supporting adjacent panels at the foot of said wall structure, said base member also including upright guides for aligning panels of other unitary structures during construction of the wall structure.

11. A wall structure according to claim 10 including a plurality of base members arranged in end to end relation with said lateral extensions abutting each other, one of said unitary structures having its panel resting on said abutting lateral extensions and another of said unitary structures having its panel resting on said base member parcel, whereby said one structure and said another structure are in adjacent vertical rows and offset by the height of said base member panel.

12. A quay structure for a navigable body of water comprising:

a wall resting on the bottom of the body of water and extending above the surface of the water, said wall including a plurality of individual panels, said panels having substantially the same thickness as said wall and having a height less than the height of said wall and a length less than the length of said wall, said panels being arranged in edge to edge relation in vertical rows;

a body of particulate fill material on the shore side of the wall, said fill extending to a height above said water surface;

a plurality of substantially rigid truss members secured to the shore side of said wall below the surface of the water, extending substantially horizontally through said fill amount and retained against longitudinally displacement thereby;

a plurality of elongated flexible reinforcement elements secured to the shore side of the wall above the surface of the water, extending substantially horizontally in said fill material and retained against longitudinal displacement thereby;

a monolithic cope member having a wall portion in substantial vertical alignment with said wall, superimposed on said fill material, said cope member being spaced from said wall and being supported by resting on said fill into which said plurality of elongated flexible reinforcement elements extend.

13. A quay structure according to claim 12 wherein said cope member includes a base portion, said base portion extends outwardly from said wall portion on the shore side of said wall portion and has an upper and lower surface, and including a body of fill material superimposed on said upper surface of said base portion, whereby frictional engagement of said base portion in said fill material resists displacement of said cope member.

14. A quay structure according to claim 12 wherein said wall includes a plurality of base members resting on foundation means on the bottom, and includes a plurality of full panels and a plurality of half panels, said truss members being secured to said members and said full panels, and said reinforcement elements being secured to said half panels.

15. A quay structure according to claim 14 wherein said full panels are hexagonal with upper and lower horizontal edges and a pair of inclined edges intersecting said horizontal edges.

16. A quay structure according to claim 15 wherein one of said horizontal edges has a longitudinal rib and the other of said horizontal edges has a longitudinal groove.

17. A quay structure according to claim 14 wherein said base members include a central portion and lateral extensions projecting outwardly from said central portion, said central portion having a horizontal edge and a pair of outwardly inclined edges intersecting said horizontal edge.

18. A quay structure according to claim 14 wherein said base members include a pair of upright guide members, said panels having guide means for receiving said guide members and for maintaining vertical alignment of said panels.

19. A quay structure according to claim 18 wherein said guide members are substantially rigid elongated members secured in said base members and said guide means are slots in said panels.

20. A quay structure according to claim 19, wherein said panels have a horizontal lower edge and inclined edges at each end of the panel, said inclined edges sloping outwardly from said lower edge, said slots in said panels intersecting said inclined edges.

* * * * *